US009656483B2

(12) United States Patent
Inaba

(10) Patent No.: US 9,656,483 B2
(45) Date of Patent: May 23, 2017

(54) CONVEYANCE METHOD UTILIZING A SWING GUIDE

(71) Applicant: TOSHIBA TEC KABUSHIKI KAISHA, Shinagawa-ku, Tokyo (JP)

(72) Inventor: Hiroyuki Inaba, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/186,777

(22) Filed: Jun. 20, 2016

(65) Prior Publication Data

US 2016/0297211 A1 Oct. 13, 2016

Related U.S. Application Data

(62) Division of application No. 14/524,137, filed on Oct. 27, 2014, now Pat. No. 9,393,805.

(51) Int. Cl.

| | |
|---|---|
| ***B41J 11/00*** | (2006.01) |
| ***B41J 3/407*** | (2006.01) |
| ***B41J 3/28*** | (2006.01) |
| ***B42D 9/04*** | (2006.01) |
| ***B65H 29/12*** | (2006.01) |
| ***B65H 29/52*** | (2006.01) |

(52) U.S. Cl.

CPC ..... *B41J 11/0045* (2013.01); *B41J 3/283* (2013.01); *B41J 3/407* (2013.01); *B41J 11/0095* (2013.01); *B42D 9/04* (2013.01); *B65H 29/125* (2013.01); *B65H 29/52* (2013.01); *B65H 2403/942* (2013.01); *B65H 2404/63* (2013.01); *B65H 2408/13* (2013.01); *B65H 2511/214* (2013.01); *B65H 2701/1311* (2013.01)

(58) Field of Classification Search

CPC .... B41J 11/0045; B41J 11/0095; B41J 3/283; B41J 3/407; B65H 29/125; B65H 29/52; B65H 2403/942; B65H 2511/214; B65H 2701/1311; B65H 2408/13; B65H 2404/63; B42D 9/04

See application file for complete search history.

(56) References Cited

U.S. PATENT DOCUMENTS

2006/0219784 A1 10/2006 Ito

FOREIGN PATENT DOCUMENTS

| | | | |
|---|---|---|---|
| JP | 2000-127652 | | 5/2000 |
| JP | 2000127652 A | * | 5/2000 |
| JP | 2001-225571 | | 8/2001 |

OTHER PUBLICATIONS

Non-Final Office Action for U.S. Appl. No. 14/524,137 dated Oct. 30, 2015, 31 pages.

* cited by examiner

*Primary Examiner* — Bradley Thies
(74) *Attorney, Agent, or Firm* — Amin, Turocy & Watson LLP

(57) ABSTRACT

A conveyance method involves a conveyance control step of conveying a printing medium at least including a booklet along a conveyance surface; and a swing guide control step of rotating a swing guide before the printing medium passes a gap between the swing guide and a page turning roller until a first end of a flat section is above an arrangement surface of a conveyance surface and a second end of the flat section is below the arrangement surface of the conveyance surface, wherein the first end of the flat section is located further along the conveyance direction than the second end of the flat section.

7 Claims, 17 Drawing Sheets

CONVEYANCE METHOD UTILIZING A SWING GUIDE

CROSS-REFERENCE TO RELATED APPLICATIONS

This application is a Divisional of application Ser. No. 14/524,137 filed on Oct. 27, 2014, the entire contents of which are incorporated herein by reference.

FIELD

Embodiments described herein relate to a printing apparatus and a conveyance method.

BACKGROUND

A printing apparatus is known which prints on a booklet such as a bankbook. Generally, the printing apparatus printing on a booklet is provided with a page turning mechanism for turning pages of the booklet and a conveyance path for conveying a printing medium such as a booklet to each section of the printing apparatus. The page turning mechanism is arranged in the middle of the conveyance path. The printing medium passes through the position where the page turning mechanism is arranged and is then conveyed to each section of the printing apparatus.

The page turning mechanism is inevitably complicated in structure for its properties. The complicated structure of a mechanism is the main reason why paper jam (hereinafter referred to as JAM) occurs.

DETAILED DESCRIPTION

Figure 1:
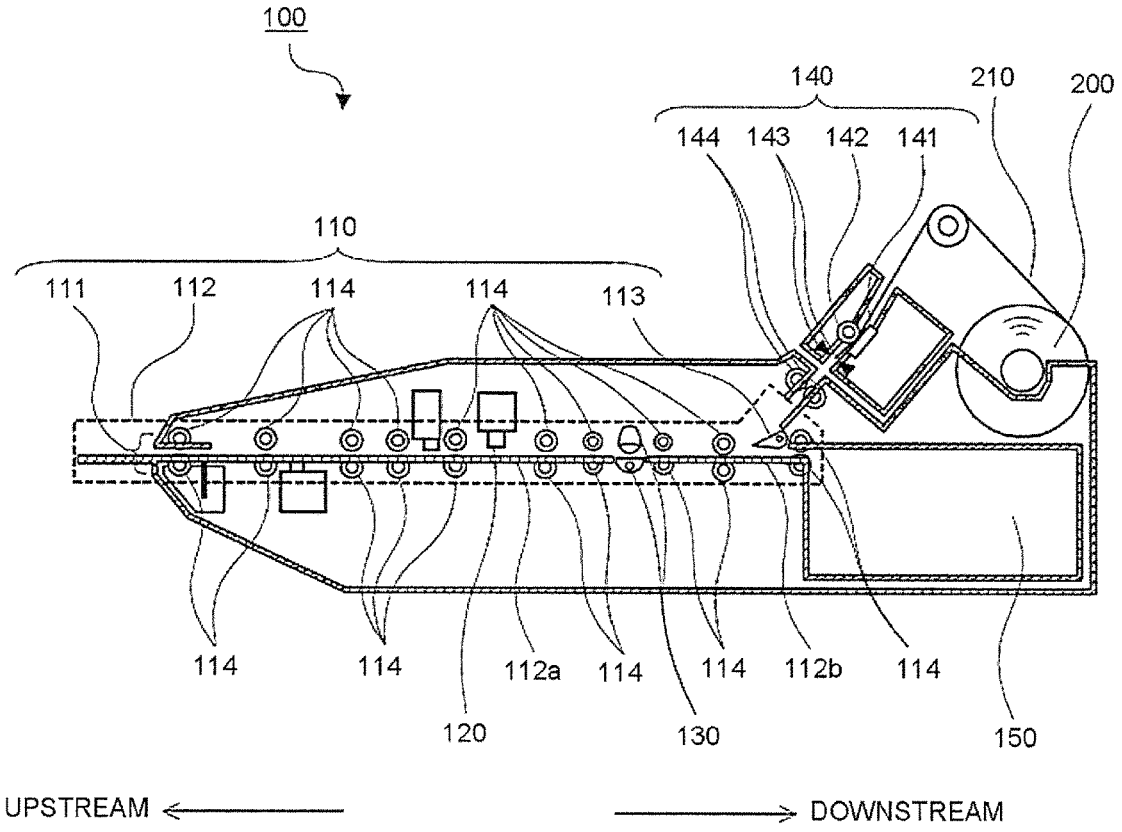
FIG. 1 is a diagram illustrating the internal structure of a printing apparatus according to embodiment 1.

In accordance with an embodiment, a printing apparatus comprises a conveyance mechanism configured to convey a printing medium at least including a booklet along a conveyance surface; a page turning mechanism comprising a swing guide which has a flat section substantially on the same plane with the conveyance surface at a preset rotation position and rotates around a shaft substantially orthogonal to the conveyance direction of the printing medium to incline the flat section with respect to the conveyance surface to bend the booklet on the flat section and a page turning roller configured at a position opposite to the flat section of the swing guide and abutted against the booklet bent by the swing guide to turn pages of the booklet, and a swing guide control section configured to enable the swing guide to rotate before the printing medium passes through the gap between the flat section and the page turning roller until the one of the ends of the flat section at the side of the conveyance direction which is located at the side of the advancing direction of the printing medium is above the arrangement surface of the conveyance surface and the other end is below the arrangement surface of the conveyance surface.

Embodiments of the present invention are described below with reference to the accompanying drawings, in each of which identical or equivalent components are denoted by identical reference numerals.

Embodiment 1

The printing apparatus 100 provided in the present embodiment is a bankbook printing apparatus for printing information such as the content of a transaction on a printing medium such as a bankbook, a statement and the like. Here, the 'statement' refers to a sheet on which the details of a transaction are recorded. The printing apparatus 100 may be arranged in an ATM (Automated Teller Machine).

Figure 2:
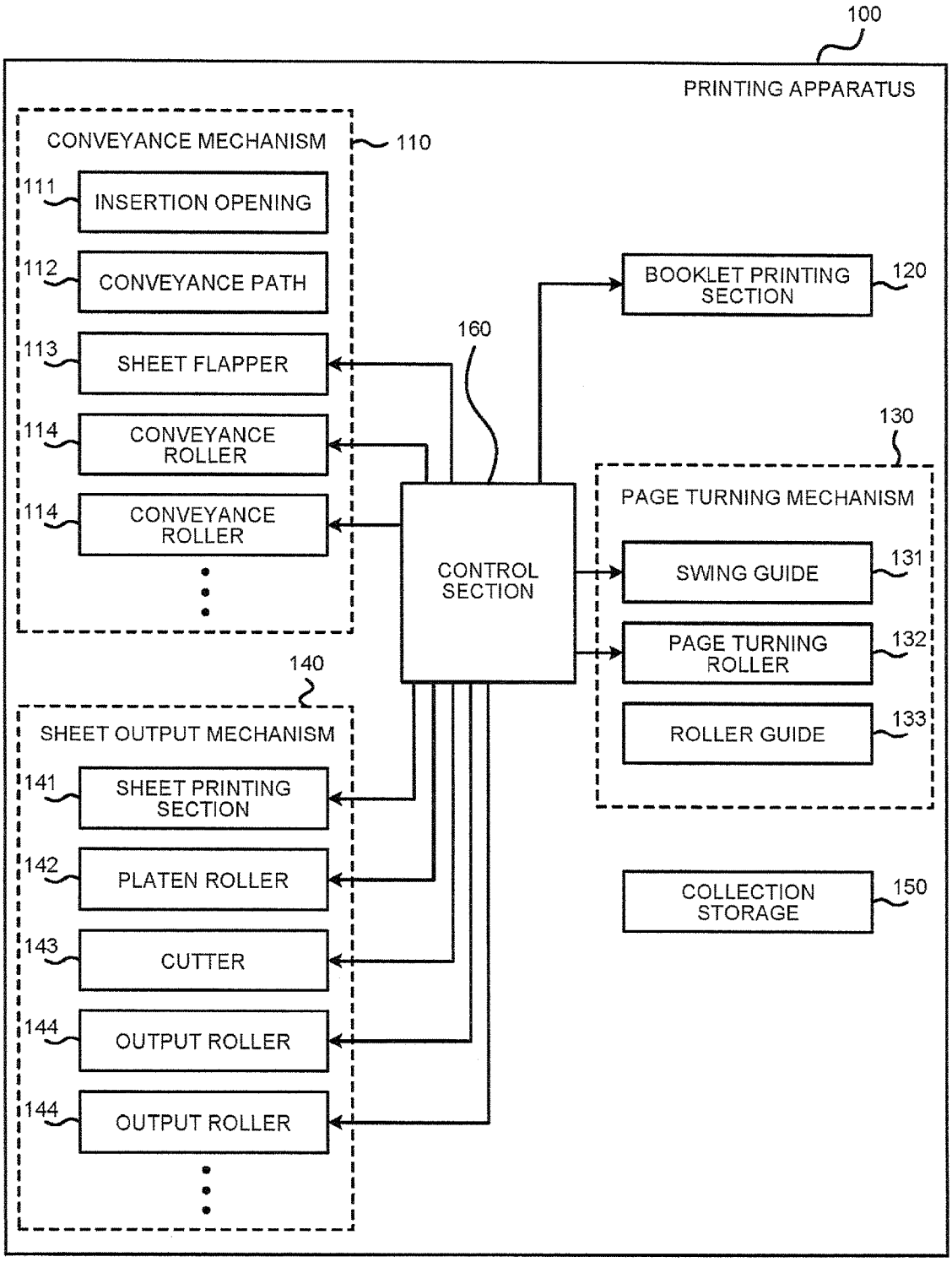
FIG. 2 is a block diagram illustrating the printing apparatus of the embodiment 1.

As shown in FIG. 1, the printing apparatus 100 comprises a conveyance mechanism 110, a booklet printing section 120, a page turning mechanism 130, a sheet output mechanism 140 and a collection storage 150. Further, as shown in FIG. 2, the printing apparatus 100 has a control section 160 therein.

The conveyance mechanism 110 which is used for conveying the printing medium to each section of the printing apparatus 100 consists of an insertion opening 111, a conveyance path 112, a sheet flapper 113 and a conveyance roller 114, as shown in FIG. 1.

The insertion opening 111 is an opening for the insertion and discharging of the printing medium. A bankbook 300 is inserted into the insertion opening 111 with facing pages thereof facing up.

The conveyance path 112 is a path for conveying the printing medium which refers to the bankbook 300 or a sheet 210. The conveyance path 112 comprises a conveyance surface 112*a* linearly extending from the insertion opening 111 to the page turning mechanism 130 and a conveyance surface 112*b* linearly extending from the page turning mechanism 130 to the collection storage 150. The printing medium is conveyed along the conveyance surfaces. The conveyance path 112 is branched into two paths at the downstream rear end. Specifically, the conveyance path 112 is branched into a path linearly leading to the collection storage 150 and a path leading to the sheet output mechanism 140 from the linear path. The printed sheet 210 is output by the sheet output mechanism 140 from the path leading to the sheet output mechanism 140. Additionally, hereinafter, the side of the insertion opening 111 in the conveyance path 112 is referred to as 'upstream', and the side of the opposite collection storage 150 is referred to as 'downstream'.

The sheet flapper 113 is a switching device for switching between movement directions of the bankbook 300. The sheet flapper 113 is arranged nearby the position where the path leading to the collection storage 150 and the path leading to the sheet output mechanism 140 are merged.

The conveyance roller 114 is a roller for conveying the bankbook 300. The conveyance roller 114 consists of, for example, a cylinder the outer peripheral surface of which is covered by an elastic member such as rubber and the like. An upper conveyance roller 114 and a lower conveyance roller 114 are arranged in pair. The conveyance rollers 114 convey the bankbook 300 to the upstream or the downstream side while applying a clamping pressure to the bankbook 300 with two upper/lower rollers. Further, a pressure sensor (not shown) is arranged on the conveyance roller 114 at the furthest upstream side of the conveyance path 112 to capture the change in the clamping pressure. The control section 160 detects the insertion of the printing medium into the insertion opening 111 according to the value of the pressure sensor.

The booklet printing section 120 is a printing device for printing information such as transaction information on the bankbook 300. The booklet printing section 120 consisting of, for example, a dot printer activates a printer head such as a dot head under the control of the control section 160 to print information on the bankbook 300.

Figure 3:
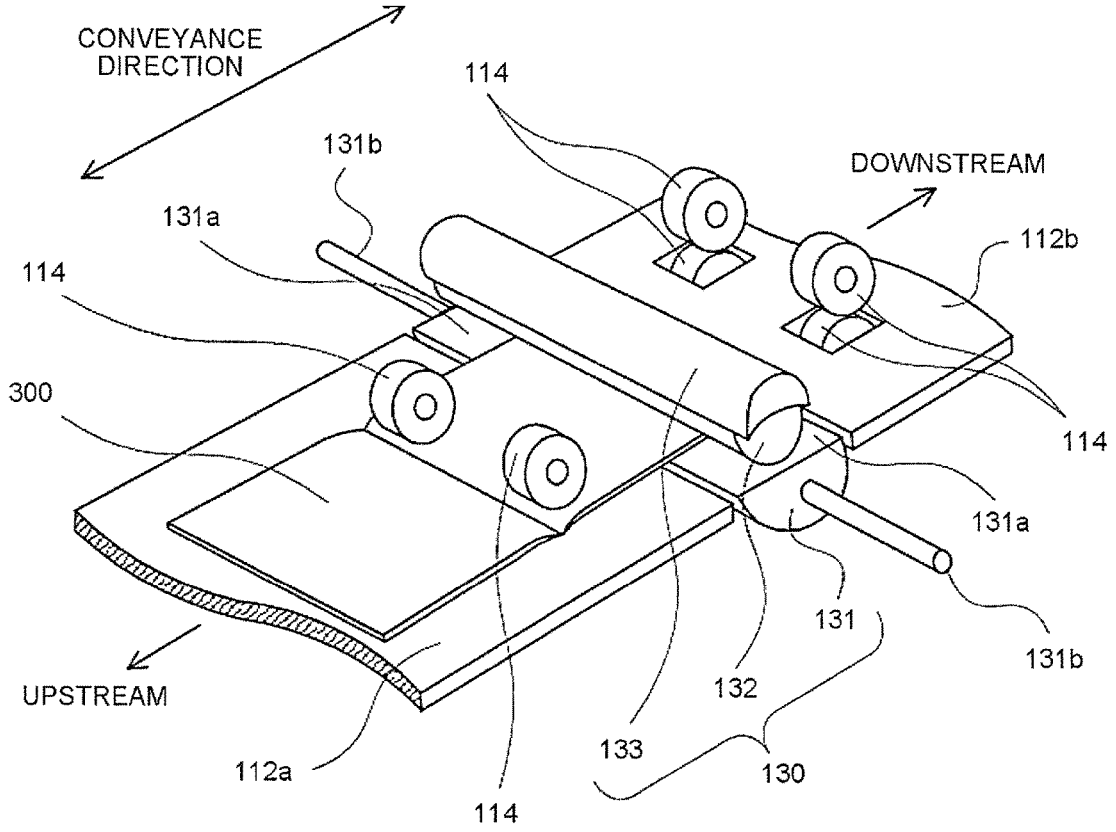
FIG. 3 is an oblique view showing the page turning mechanism of a printing apparatus.

The page turning mechanism 130 is a mechanism for turning pages of the bankbook 300. As shown in FIG. 3, the page turning mechanism 130 consists of a swing guide 131, a page turning roller 132 and a roller guide 133.

Figure 4A:
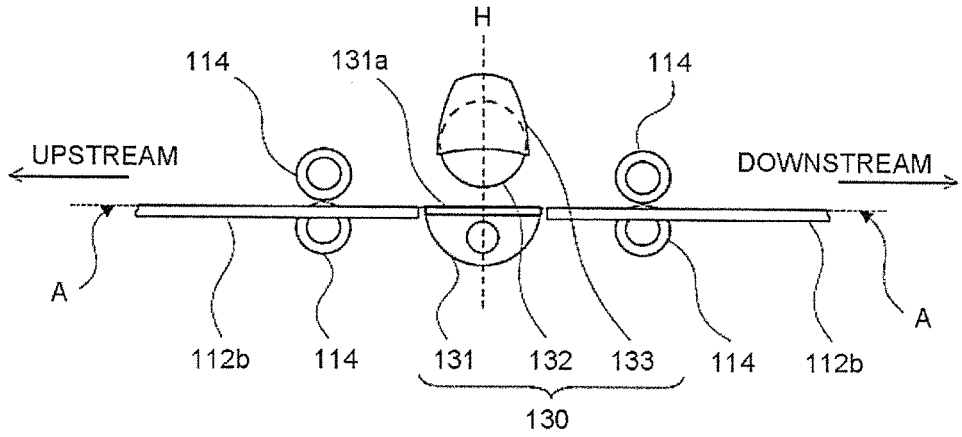
FIG. 4A is a diagram illustrating a page turning mechanism the swing guide of which is at a home position.
Figure 4B:
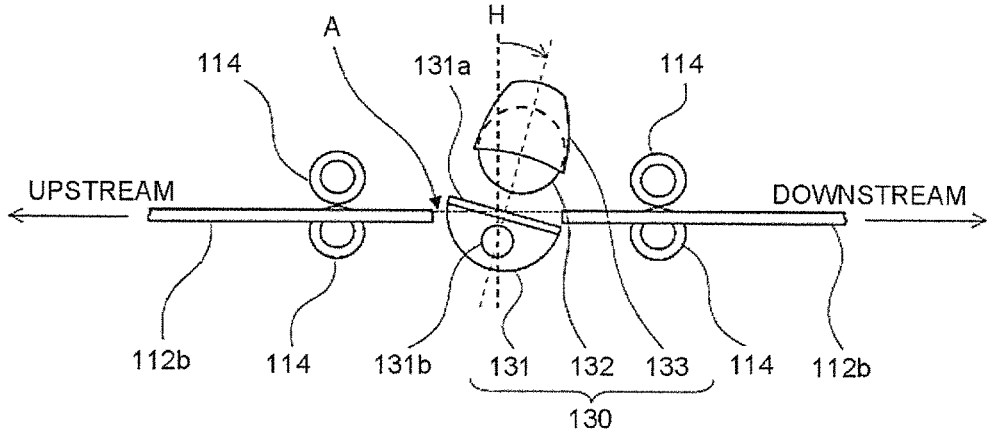
FIG. 4B is a diagram illustrating a page turning mechanism the swing guide of which is rotated towards a downstream side.
Figure 4C:
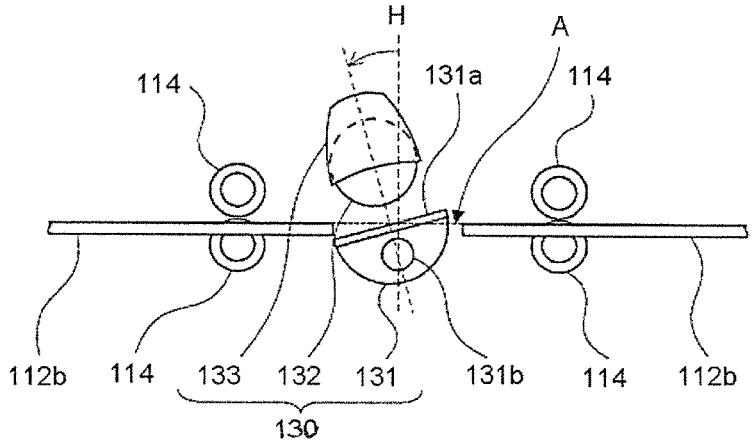
FIG. 4C is a diagram illustrating a page turning mechanism the swing guide of which is rotated towards an upstream side.

The swing guide 131 is a mechanism for enabling the page turning roller 132 to turn pages of the bankbook 300. Specifically, the swing guide 131 is a mechanism for applying a pressure from the lower part to the bankbook 300 in a case where the bankbook is above the swing guide 131 to bend the bankbook 300. The swing guide 131 takes the shape of a semi-cylinder and has a flat section 131*a* on the upper portion thereof. The swing guide 131 has a rotation shaft 131*b* which is arranged at a position substantially orthogonal to the conveyance direction of the printing medium such as the bankbook 300. Under the control of the control section 160, the swing guide 131 rotates around the rotation shaft 131*b*. When the swing guide 131 is at a home position H, the flat section 131*a* is substantially on the same plane surface with the arrangement surface (hereinafter referred to as 'arrangement surface A') of the conveyance surface 112*a* and the conveyance surface 112*b*, as shown in FIG. 4A. Besides, the 'home position H' refers to the reference rotation position during the rotation of the swing guide 131 which is preset by the producer of the apparatus. By rotating the swing guide 131 around the rotation shaft 131*b*, the flat section 131*a* can be inclined with respect to the arrangement surface A, as shown in FIG. 4B and FIG. 4C.

The page turning roller 132 is a roller for turning pages of the bankbook 300. The page turning roller 132 consists of, for example, a cylinder the outer peripheral surface of which is covered by an elastic member. As shown in FIG. 4A, the page turning roller 132 is arranged at a position opposite to the flat section 131*a*. The page turning roller 132 is fixed on the rotation shaft 131*b* by a fitting (not shown). When the swing guide 131 rotates, the page turning roller 132 rotates around the rotation shaft 131*b* opposite to the flat section 131*a*, as shown in FIG. 4B and FIG. 4C.

The roller guide 133 is a cover covering the upper half part of the page turning roller 132. The roller guide 133 is a component for preventing the page turned by the page turning roller 132 from being rolled into the page turning roller 132. The operations of the page turning mechanism 130 are described later with reference to the following page turning processing in detail. Additionally, not limited to the exemplary form shown in accompanying drawings, the page turning mechanism 130 can be any of other existing forms.

Figure 5:
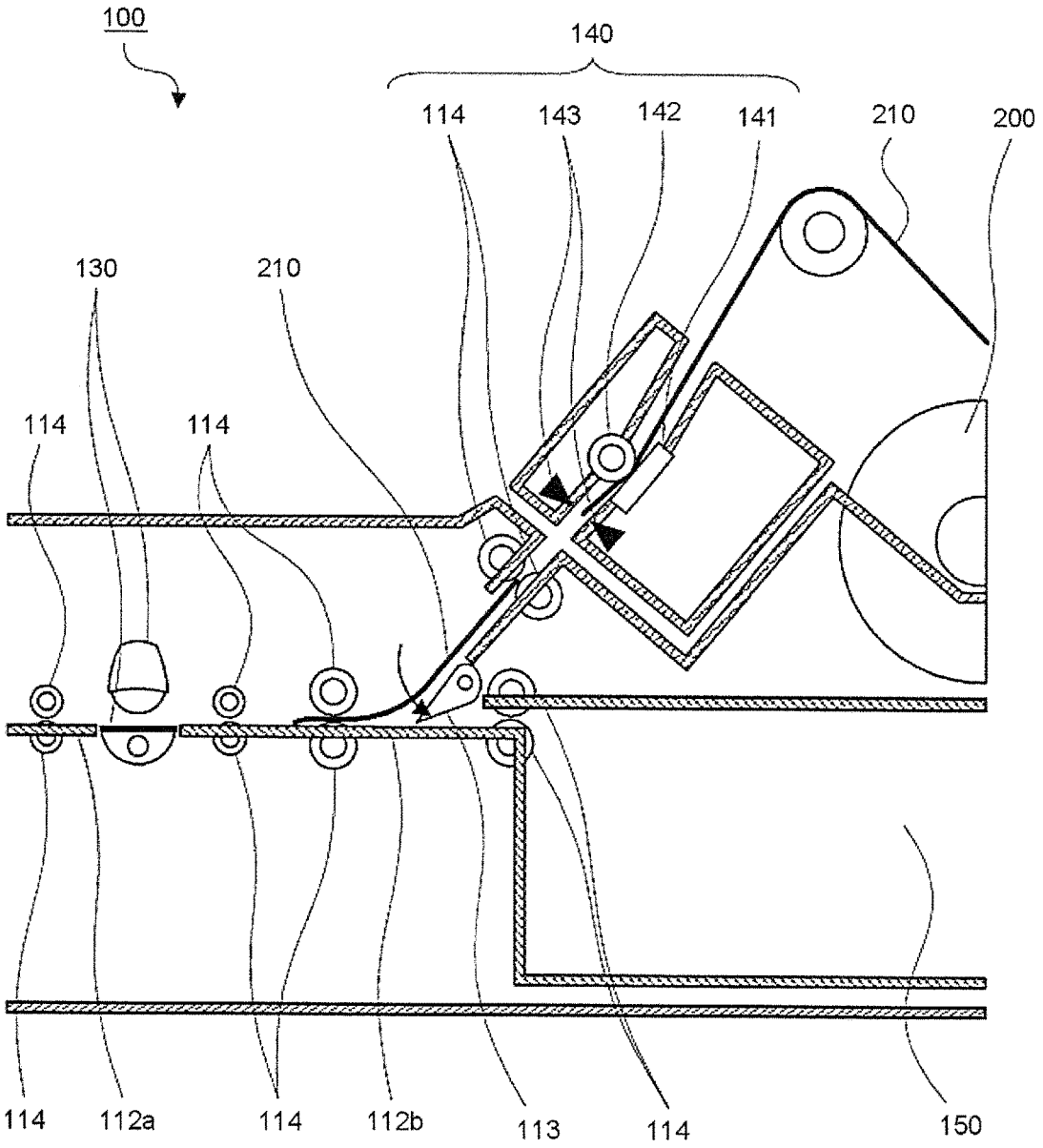
FIG. 5 is a diagram illustrating the output of a sheet from a sheet output mechanism.

Return to FIG. 1, the sheet output mechanism 140 is a mechanism for outputting the sheet 210 towards the conveyance surface 112*b*. The sheet 210 is fed from the roll 200. The roll 200 is a reel on which the sheet 210 is wounded and which is detachably arranged on the printing apparatus 100. In addition to the function of outputting the sheet 210, the sheet output mechanism 140 further has a function of printing on the sheet 210. As shown in FIG. 5, the sheet output mechanism 140 consists of a Print head 141, a platen roller 142, a cutter 143 and an output roller 144.

The Print head 141 is, for example, a thermal head consisting of a plurality of heating elements which are arranged in a row. The Print head 141 selectively heats the heating elements under the control of the control section 160 to transfer ink (not shown) onto the sheet 210.

The platen roller 142 which is a roller for crimping the sheet 210 against the Print head 141 consists of, for example, a cylinder the outer peripheral surface of which is covered by an elastic member. The platen roller 142 conveys the sheet 210 abutted against the outer peripheral surface thereof to the downstream side under the control of the control section 160.

The cutter 143 is a cutting component for cutting the sheet 210. The cutter 143 cuts and separates the printing part of the sheet 210 from the sheet 210 printed by the printer head 141.

The output roller 144 is a roller for outputting the sheet 210 cut and separated by the cutter 143 to the upstream side. The output roller 144 consists of, for example, a cylinder the outer peripheral surface of which is covered by an elastic member. Like the conveyance rollers 114, an upper and a lower output roller 144 are arranged in pair. The upper/lower output rollers 144 convey the sheet 210 to the conveyance surface 112*b* while applying a clamping pressure to the sheet 210.

Figure 6:
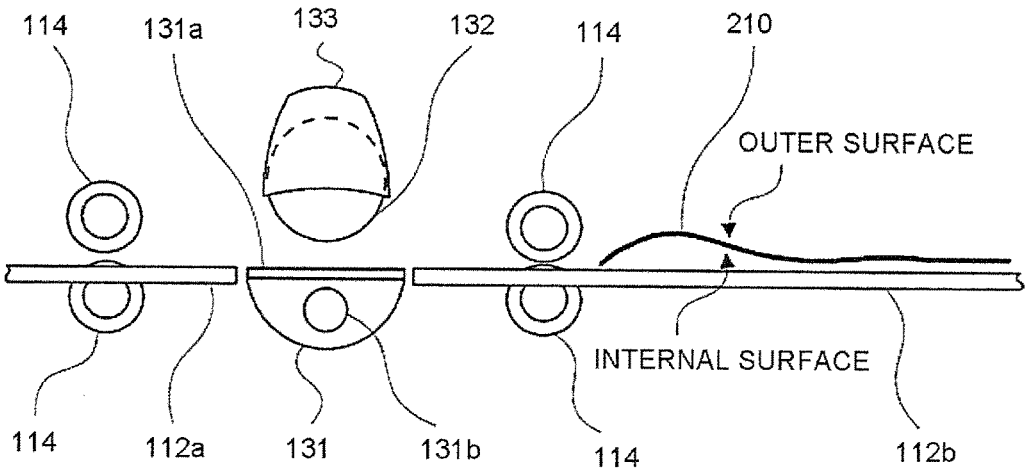
FIG. 6 is a diagram illustrating a situation in which the internal surface of a sheet is opposite to a conveyance surface.

Further, as the sheet 210 is wound on the roll 200, both ends of the sheet 210 are bent when the sheet is discharged from the sheet output mechanism 140. The sheet 210 both ends of which are bent upward can be easily hooked by a mechanism (e.g. the page turning roller 132) above the conveyance surface. Thus, as shown in FIG. 6, the sheet output mechanism 140 outputs the sheet 210 with the one of the two sides of the sheet 210 facing the center of the roll 200 (hereinafter referred to as 'internal surface') opposite to the conveyance surfaces (conveyance surfaces 112*a* and 112*b*). Thus, the sheet 210 can hardly be hooked by the mechanism above the conveyance surface.

Return to FIG. 1, the collection storage 150 is a storage chamber for storing the bankbook 300 and the sheet 210. The bankbook 300 and the sheet 210 which are returned from the insertion opening 111 after being forgotten to be taken away by the user are stored in the collection storage 150.

Figure 7:
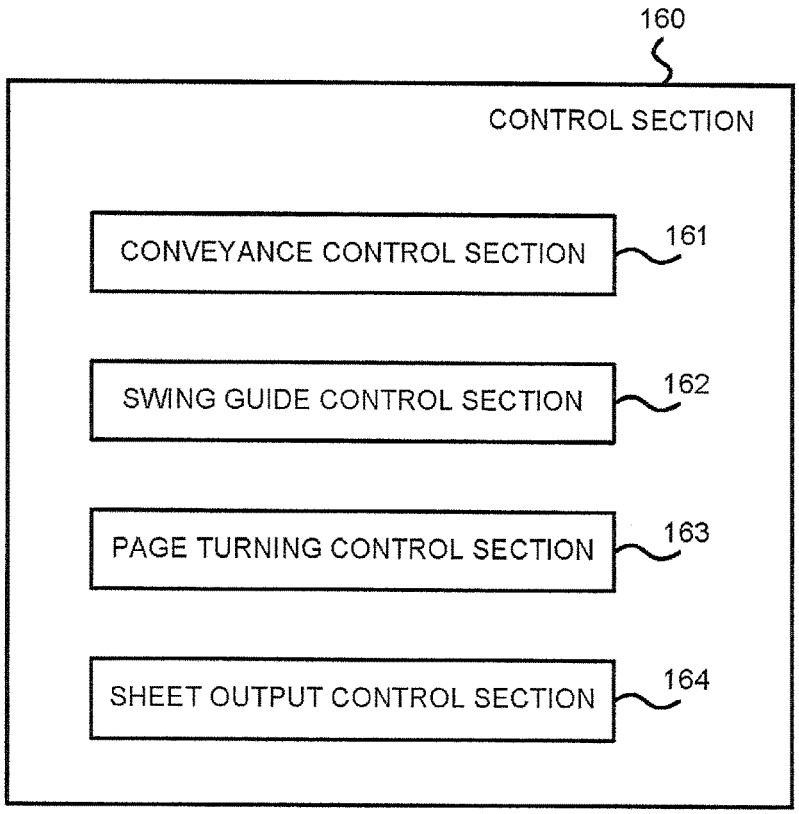
FIG. 7 is a functional block diagram illustrating the functions of the control section of the printing apparatus of the embodiment 1.

Return to FIG. 2, the control section 160 which consists of a processing device such as a processor acts according to a program stored in a ROM (Read Only Memory) (not shown) or RAM (Random Access Memory) (not shown) to carryout various processing including the under-mentioned 'page turning processing' and 'sheet output processing'. By carrying out the 'page turning processing' and the 'sheet output processing', the control section 160 functions as a conveyance control section 161, a swing guide control section 162, a page turning control section 163 and a sheet output control section 164, as shown in FIG. 7. These functions are described in the following 'page turning processing' and 'sheet output processing'. The control section 160 may consist of one or a plurality of processors. In the case where the control section 160 consists of a plurality of processors, the control section 160 may print on the bankbook through the cooperation of the plurality of processors.

Next, the operations of the printing apparatus 100 with the structure above are described below.

The operations of the printing apparatus 100 are roughly divided into a 'page turning processing' of turning pages of the bankbook 300 and a 'sheet conveyance processing' of conveying the sheet 210 into the insertion opening 111. The page turning processing is described first.

When an instruction indicating the execution of a page turning processing is given from an external apparatus (e.g. a processor for controlling the ATM), the control section 160 carries out the 'page turning processing'. For example, the page turning processing is carried out when there is no blank on the currently opened page or when the currently opened page is not the page desired to be printed. The 'page turning processing' is described with reference to the flowchart of FIG. 8.

The conveyance control section 161 of the control section 160 conveys the bankbook 300 at the booklet printing section 120 to the front of the page turning mechanism 130 (ACT S101).

Figure 9:
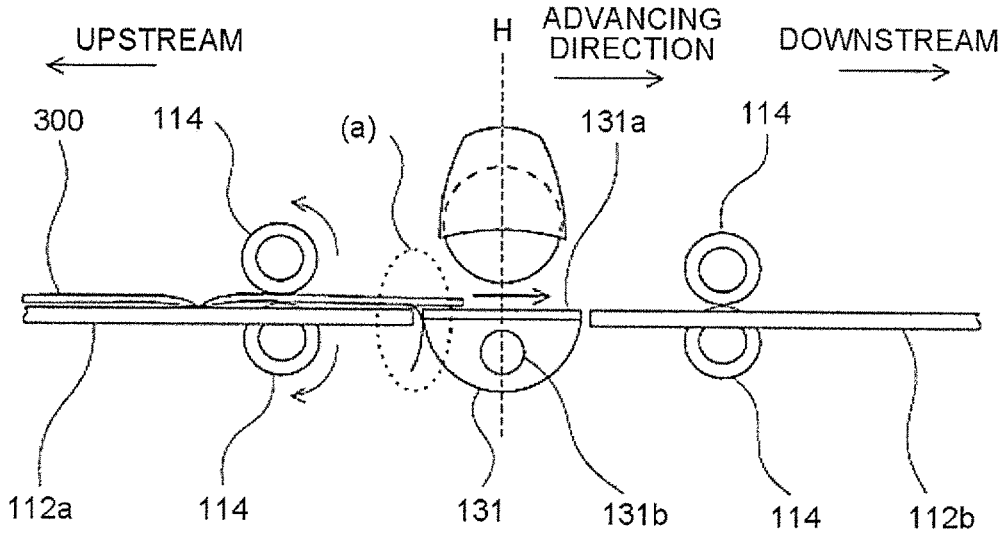
FIG. 9 is a diagram illustrating the entrance of the cover of a bankbook into the gap between a flat section and a conveyance surface.

Generally, to move a movable component smoothly, it is needed to set a gap between a movable component and an adjacent component. Similarly, in this embodiment, to rotate the swing guide 131 smoothly, it is needed to set a small gap between the swing guide 131 and the conveyance surfaces (conveyance surfaces 112*a* and 112*b*). Thus, the cover of the bankbook 300 enters the gap between the flat section 131*a* and the conveyance surfaces ((a) shown in FIG. 9) on some occasions.

Figure 10:
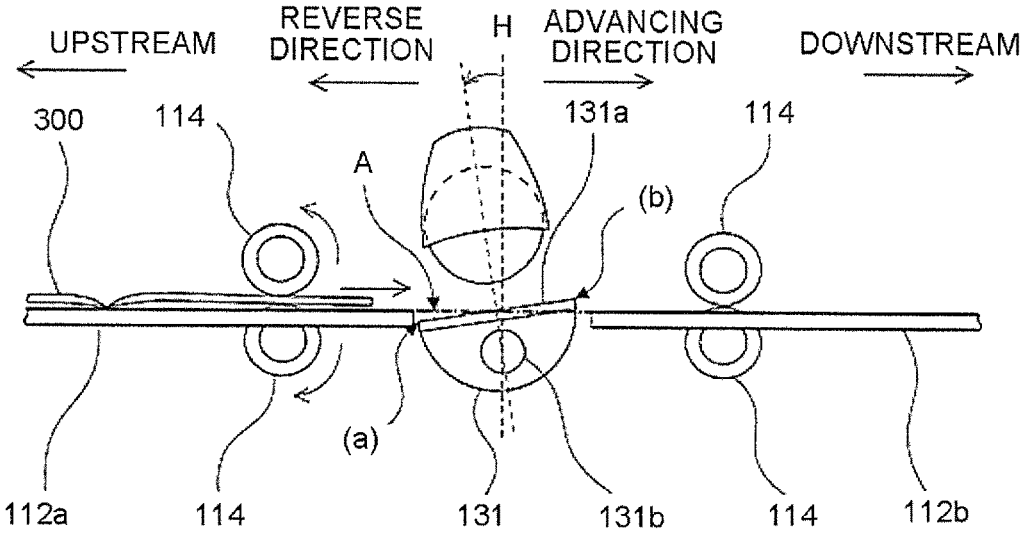
FIG. 10 is a diagram illustrating the rotation of a swing guide to an upstream side.

Thus, before the bankbook 300 passes through from above the swing guide 131, for example, the swing guide control section 162 of the control section 160 enables the swing guide 131 to rotate towards the direction reverse to the advancing direction of the bankbook 300, as shown in FIG. 10, to incline the flat section 131*a* with respect to the arrangement surface A of the conveyance surfaces (ACT S102). Specifically, the swing guide control section 162 enables the swing guide 131 to rotate until the end of the flat section 131*a* at the upstream side ((a) shown in FIG. 10) is below the arrangement surface A and the end of the flat section 131*a* at the downstream side ((b) shown in FIG. 10) is above the arrangement surface A, thereby forming a step between the conveyance surface 112*a* and the flat section 131*a* and between the flat section 131*a* and the conveyance surface 112*b* so that the bankbook 300 can hardly enter the gap between the flat section 131*a* and the conveyance surfaces.

Figure 8:
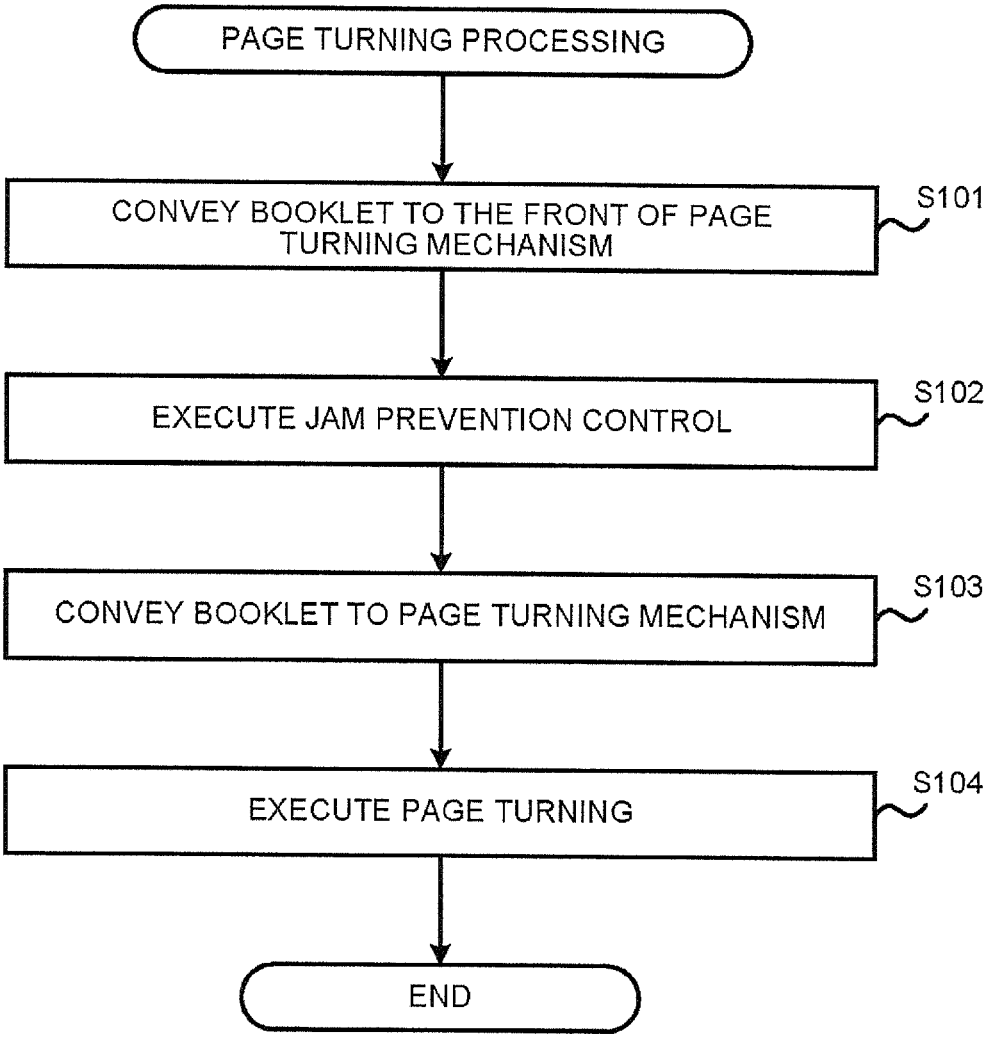
FIG. 8 is a flowchart illustrating a page turning processing according to the embodiment 1.

Return to the flow shown in FIG. 8, in order to turn pages of the bankbook 300, the conveyance control section 161 conveys the bankbook 300 towards the downstream side until the bankbook 300 is located above the swing guide 131 (ACT S103). When the one of the facing pages of the bankbook 300 at the downstream side is turned towards the upstream side, the conveyance control section 161 conveys the bankbook 300 until the downstream side of the facing pages of the bankbook 300 is above the swing guide 131. On the other hand, if the page at the upstream side is turned towards the downstream side, the conveyance control section 161 conveys the bankbook 300 until the downstream side of the facing pages of the bankbook 300 is above the swing guide 131. Next, the page turning control section 163 of the control section 160 activates the page turning mechanism 130 to turn pages of the bankbook 300 (ACT S104). The operations carried out by the page turning mechanism 130 of turning the page at the downstream side towards the upstream side are different from those carried out by the page turning mechanism 130 of turning the page at the upstream side towards the downstream side. The operations carried out by the page turning mechanism 130 of turning the page at the downstream side towards the upstream side are described first.

Figure 11A:
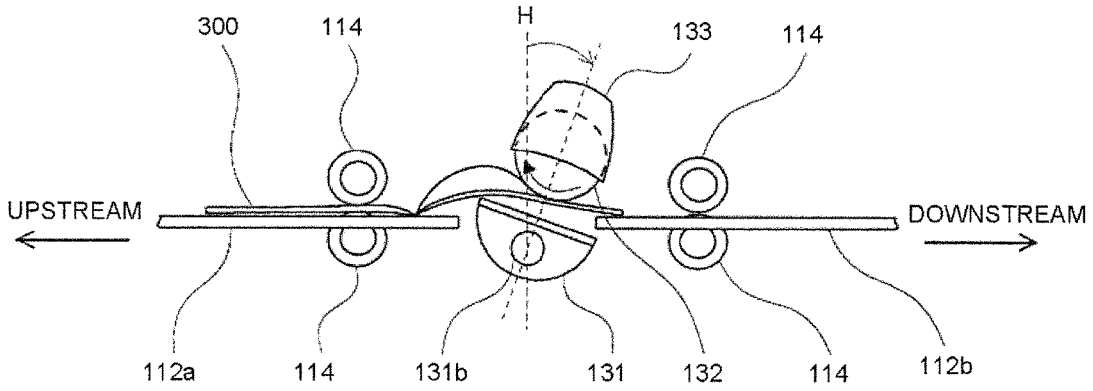
FIG. 11A is a diagram illustrating the bending of a bankbook by a swing guide.
Figure 11B:
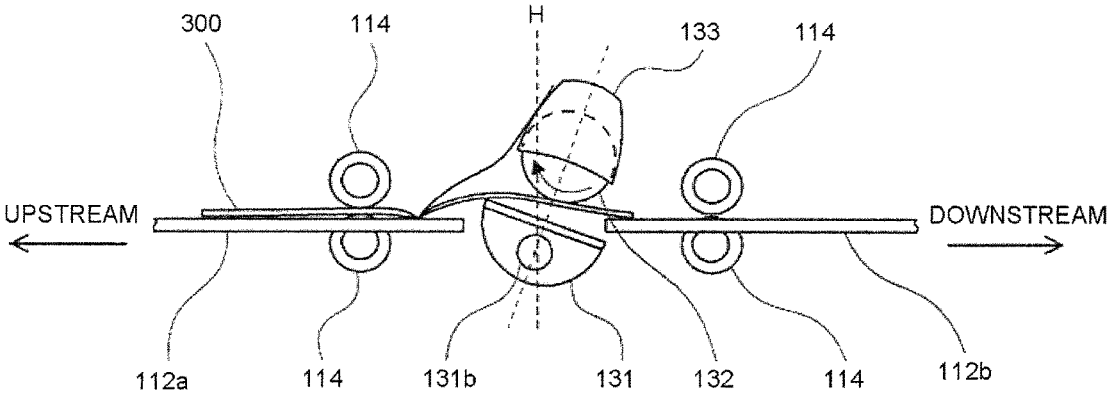
FIG. 11B is a diagram illustrating a situation in which a page of a bankbook is sprung up to a roller guide.
Figure 11C:
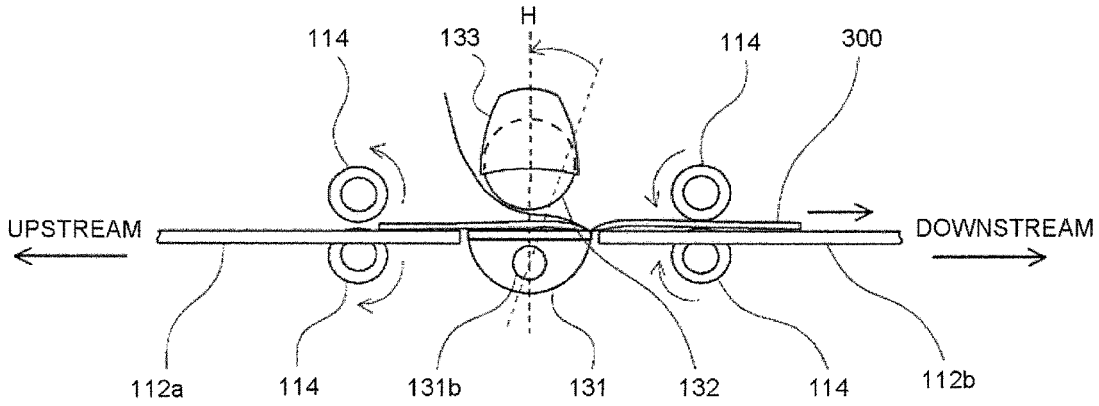
FIG. 11C is a diagram illustrating a situation in which a page is turned as the bankbook is conveyed to a downstream side.

In the case of turning the page at the downstream side towards the upstream side, the page turning control section 163 enables the swing guide 131 to rotate towards the downstream side (clockwise in FIG. 11A), as shown in FIG. 11A. In this case, the bankbook 300 is bent towards the page turning roller 132 so that the downstream side of the facing pages of the bankbook 300 is abutted against the page turning roller 132. In this state, when the page turning control section 163 enables the page turning roller 132 to rotate clockwise, the page of the bankbook 300 at the downstream side is sprung up to the roller guide section 133, as shown in FIG. 11B. Sequentially, when the page turning control section 163 controls the conveyance roller 114 to convey the bankbook 300 towards the downstream side, the sprung-up page is conveyed to the upstream side of the bankbook 300, as shown in FIG. 11C.

Figure 12A:
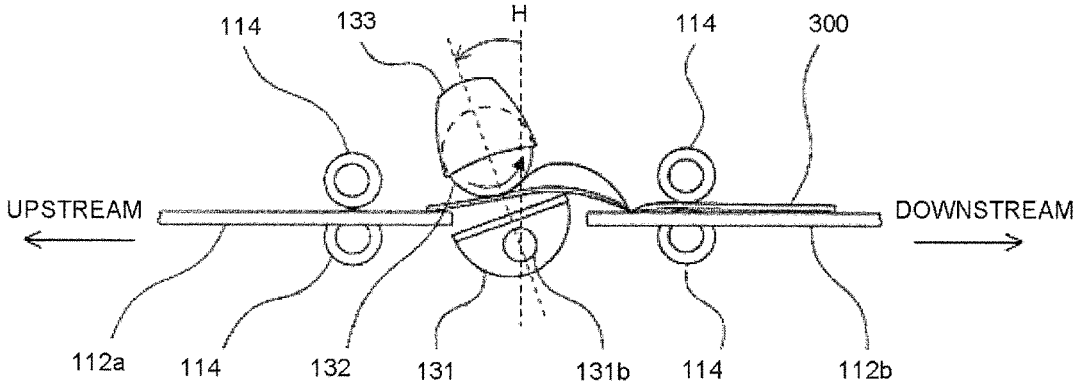
FIG. 12A is a diagram illustrating the bending of a bankbook by a swing guide.
Figure 12B:
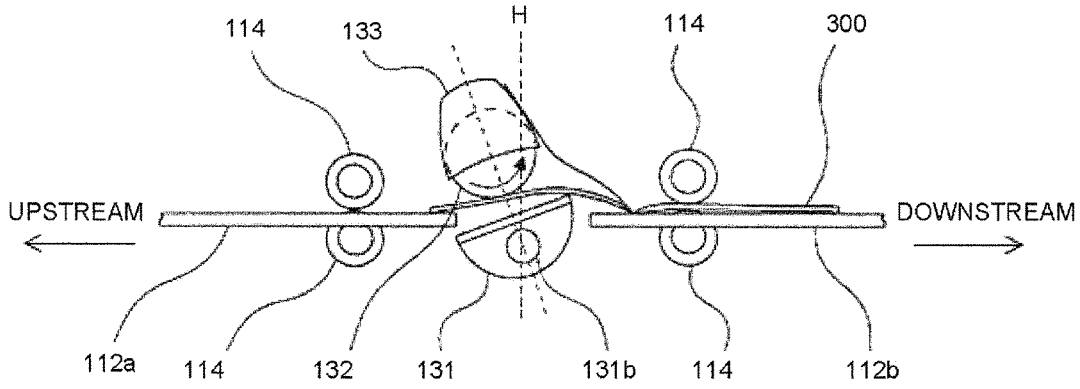
FIG. 12B is a diagram illustrating a situation in which a page of a bankbook is sprung up to a roller guide.
Figure 12C:
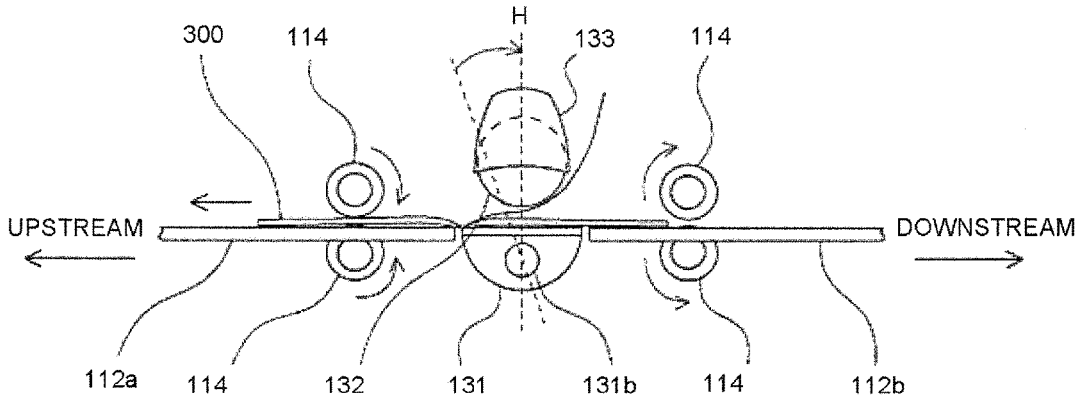
FIG. 12C is a diagram illustrating a situation in which a page is turned as the bankbook is conveyed to an upstream side.

On the other hand, in the case of turning the page at the upstream side towards the downstream side, the page turning control section 163 enables the swing guide 131 to rotate towards the upstream side (anticlockwise in FIG. 12A), as shown in FIG. 12A. In this case, the bankbook 300 is bent towards the page turning roller 132 so that the upstream side of the facing pages of the bankbook 300 is abutted against the page turning roller 132. In this state, when the page turning control section 163 enables the page turning roller 132 to rotate anticlockwise, the page of the bankbook 300 at the upstream side is sprung up to the roller guide 133, as shown in FIG. 12B. Sequentially, when the page turning control section 163 controls the conveyance roller 114 to convey the bankbook 300 towards the upstream side, the sprung-up page is conveyed to the downstream side of the bankbook 300, as shown in FIG. 12C.

If the page is turned, the control section 160 ends the page turning processing.

Next, the sheet conveyance processing is described.

When an instruction indicating the execution of a sheet output processing is given from an external apparatus, the control section 160 carries out a 'sheet output processing'. The sheet output processing is carried out by the sheet output mechanism 140 when, for example, a printing job is carried out on the sheet 210. The 'sheet output processing' is described below with reference to the flowchart of FIG. 13.

The sheet output control section 164 of the control section 160 controls the output roller 144 of the sheet output mechanism 140 to output the sheet 210 to the conveyance surface 112*b* (ACT S201). In this case, the sheet output control section 164 outputs the sheet 210 with the internal surface of the sheet 210 opposite to the conveyance surface, as shown in FIG. 6.

Figure 13:
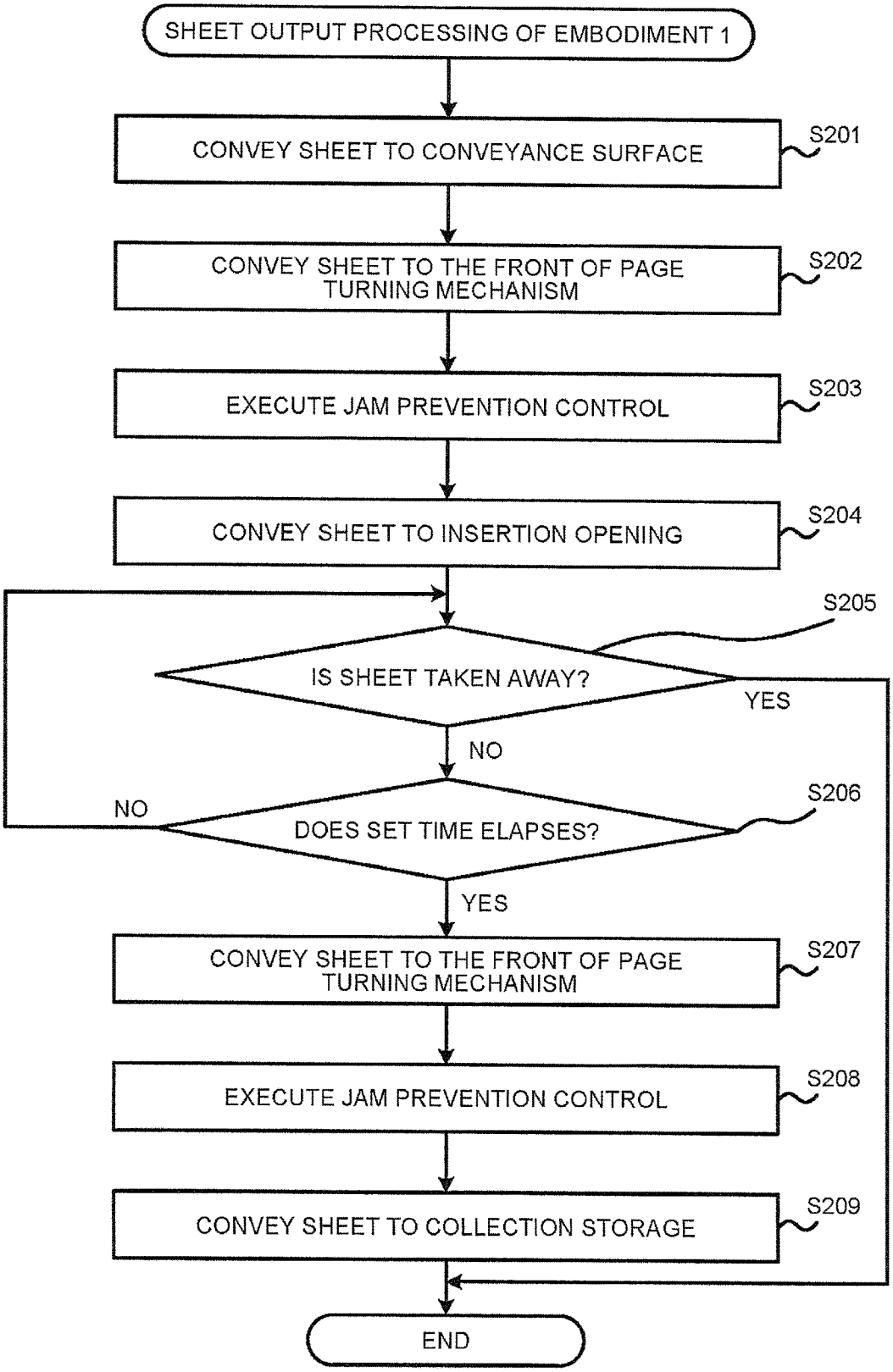
FIG. 13 is a flowchart illustrating a sheet output processing according to the embodiment 1.

Return to the flow shown in FIG. 13, the conveyance control section 161 conveys the sheet 210 output to the conveyance surface 112*b* to the front of the page turning mechanism 130 (ACT S202).

Figure 14:
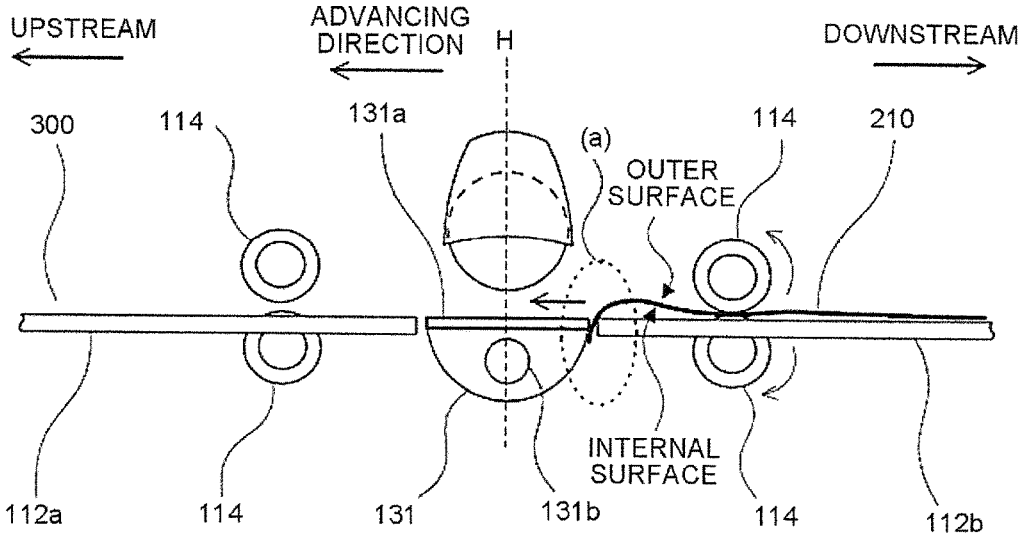
FIG. 14 is a diagram illustrating the entrance of an end of a sheet into the gap between a flat section and a conveyance surface.

As stated above, a small gap is arranged between the swing guide 131 and the conveyance surfaces (conveyance surfaces 112*a* and 112*b*). Thus, to enable the sheet 210 to pass through from above the swing guide 131, as shown in (a) of FIG. 14, an end of the sheet 210 enters the gap between the flat section 131*a* and the conveyance surface on some occasions. Especially, the sheet output control section 140 outputs the sheet 210 with the internal surface of the sheet 210 opposite to the conveyance surface. Thus, the sheet 210 is bent towards the conveyance surface such that the sheet 210 can easily enter the gap between the flat section 131*a* and the conveyance surface.

Figure 15:
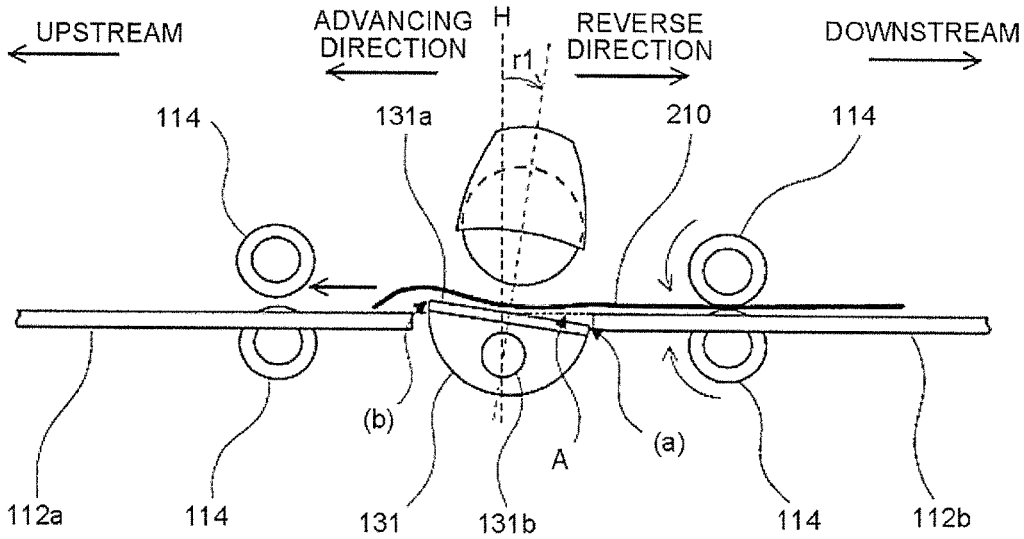
FIG. 15 is a diagram illustrating the rotation of a swing guide to a downstream side.

Thus, before the sheet 210 passes through from above the swing guide 131, for example, the swing guide control section 162 enables the swing guide 131 to rotate towards the direction reverse to the advancing direction of the sheet 210, as shown in FIG. 15, to incline the flat section 131*a* with respect to the arrangement surface A of the conveyance surfaces (ACT S203). Specifically, the swing guide control section 162 enables the swing guide 131 to rotate until the end of the flat section 131*a* at the downstream side ((a) shown in FIG. 15) is below the arrangement surface A and the end of the flat section 131*a* at the upstream side ((b) shown in FIG. 15) is above the arrangement surface A, thereby forming a step between the conveyance surface 112*a* and the flat section 131*a* and between the flat section 131*a* and the conveyance surface 112*b* so that the sheet 210 can hardly enter the gap between the flat section 131*a* and the conveyance surfaces.

Return to the flow shown in FIG. 13, the conveyance control section 161 conveys the sheet 210 to the insertion opening 111 (ACT S204).

The conveyance control section 161 determines whether or not the user takes away the sheet 210 from the insertion opening 111 according to the value of the pressure sensor (not shown) arranged on the furthest upstream conveyance roller 114 (ACT S205). If the sheet 210 is taken away (Yes in ACT S205), the control section 160 ends the sheet output processing. If the sheet 210 is not taken away (No in ACT 205), the conveyance control section 161 proceeds to ACT S206.

The conveyance control section 161 determines whether or not a preset period of time elapses (hereinafter referred to as 'set time') from the moment the sheet 210 reaches the insertion opening 111 (ACT S206). If the set time is not reached (No in ACT S206), the conveyance control section 161 returns to ACT S205. If the set time elapses (Yes in ACT S206), the conveyance control section 161 proceeds to ACT S207.

If the set time elapses (Yes in ACT S206), the conveyance control section 161 considers that the user forgets to take away the sheet 210 and therefore conveys the sheet 210 to the collection storage 150. In this case, the conveyance control section 161 stops the conveyance of the sheet 210 on one end in front of the page turning mechanism 130 (ACT S207).

Figure 16:
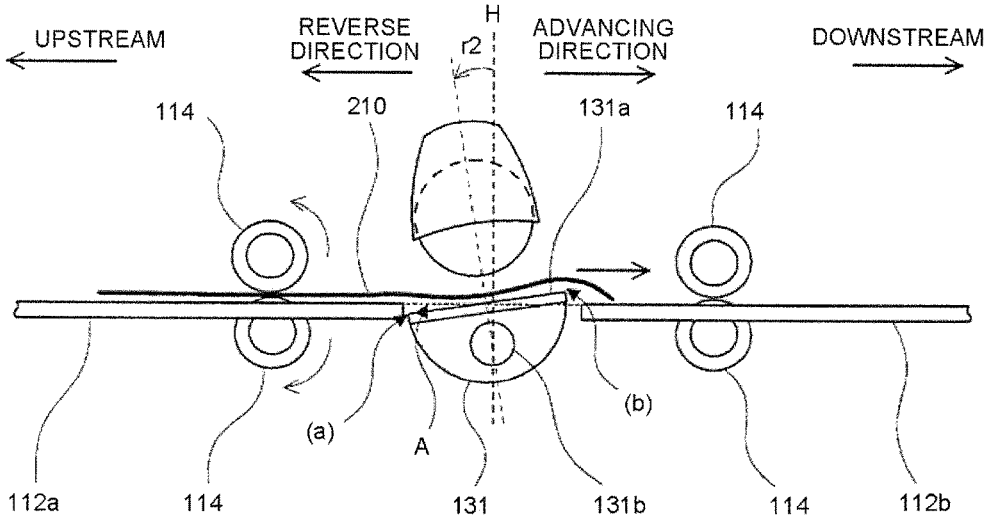
FIG. 16 is a diagram illustrating the rotation of a swing guide to an upstream side.

The swing guide control section 162 enables the swing guide 131 to rotate towards the direction reverse to the advancing direction of the sheet 210, as shown in FIG. 16, to incline the flat section 131*a* with respect to the arrangement surface A of the conveyance surfaces (ACT S208). Specifically, the swing guide control section 162 enables the swing guide 131 to rotate until the end of the flat section 131*a* at the upstream side ((a) shown in FIG. 16) is below the arrangement surface A and the end of the flat section 131*a* at the downstream side ((b) shown in FIG. 16) is above the arrangement surface A, thereby forming a step between the conveyance surface 112*a* and the flat section 131*a* and between the flat section 131*a* and the conveyance surface 112*b* so that the sheet 210 can hardly enter the gap between the flat section 131*a* and the conveyance surfaces.

Return to the flow shown in FIG. 13, the conveyance control section 161 conveys the sheet 210 towards the downstream side to collect the sheet 210 into the collection storage 150 (ACT S209). After the collection is completed, the control section 160 ends the sheet output processing.

According to the embodiment, as the swing guide 131 is rotated towards the direction reverse to the advancing direction of the printing medium before the printing medium passes the gap between the flat section 131*a* and the page turning roller 132 to incline the flat section 131*a* with respect to the arrangement surface A so that the printing medium can hardly enter the gap between the flat section 131*a* and the conveyance surfaces. As a result, JAM scarcely happens in the printing apparatus 100.

Further, as the sheet output mechanism 140 outputs the sheet 210 with the internal surface of the sheet 210 opposite to the conveyance surface, the sheet 210 is barely hooked by the mechanism above the conveyance surface. As a result, JAM scarcely happens in the printing apparatus 100.

Embodiment 2

The sheet 210 gets curlier as the sheet 210 gets closer to the center of the roll 200. In other words, a curlier sheet 210 is output from the sheet output mechanism 140 as the amount of the sheet on the roll 200 gets smaller. A curlier sheet 210 can enter the gap between the flat section 131*a* and the conveyance surface more easily. Thus, the printing apparatus 100 described in embodiment 2 can prevent the sheet 210 from entering the gap between the flat section 131*a* and the conveyance surface even if a curlier sheet 210 is output by changing the angle of the inclination of the flat section 131*a* according to the sheet residual amount. The printing apparatus 100 provided in embodiment 2 is described below.

Figure 17:
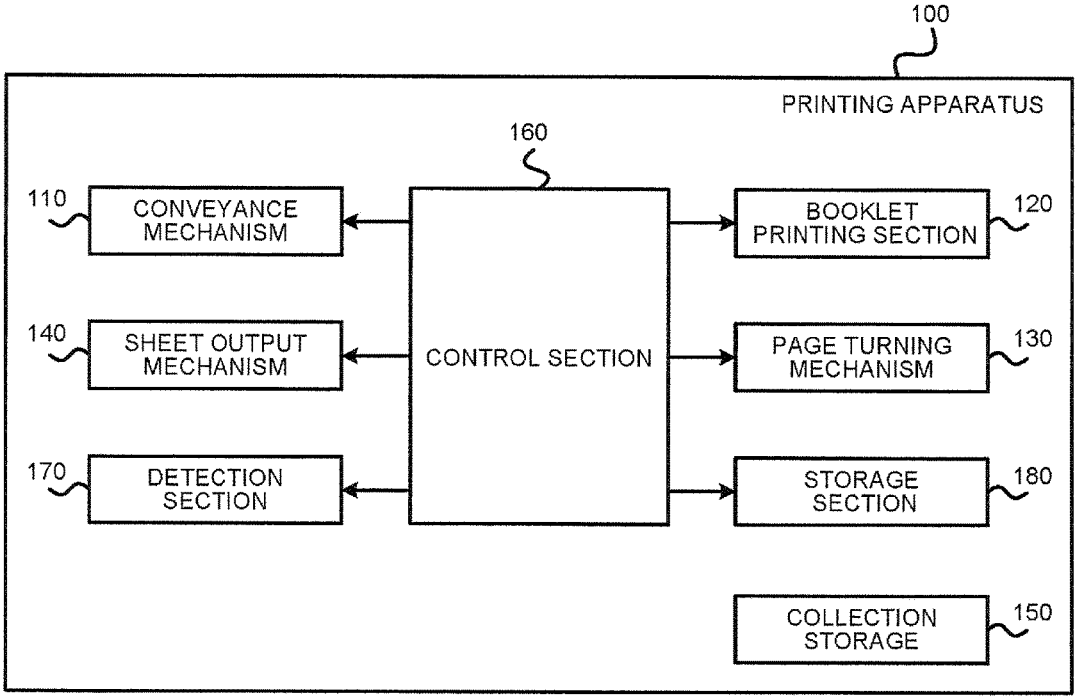
FIG. 17 is a block diagram illustrating a printing apparatus according to embodiment 2.

As shown in FIG. 17, the printing apparatus 100 comprises a conveyance mechanism 110, a booklet printing section 120, a page turning mechanism 130, a sheet output mechanism 140, a collection storage 150, a control section 160, a detection section 170 and a storage section 180.

Figure 18:
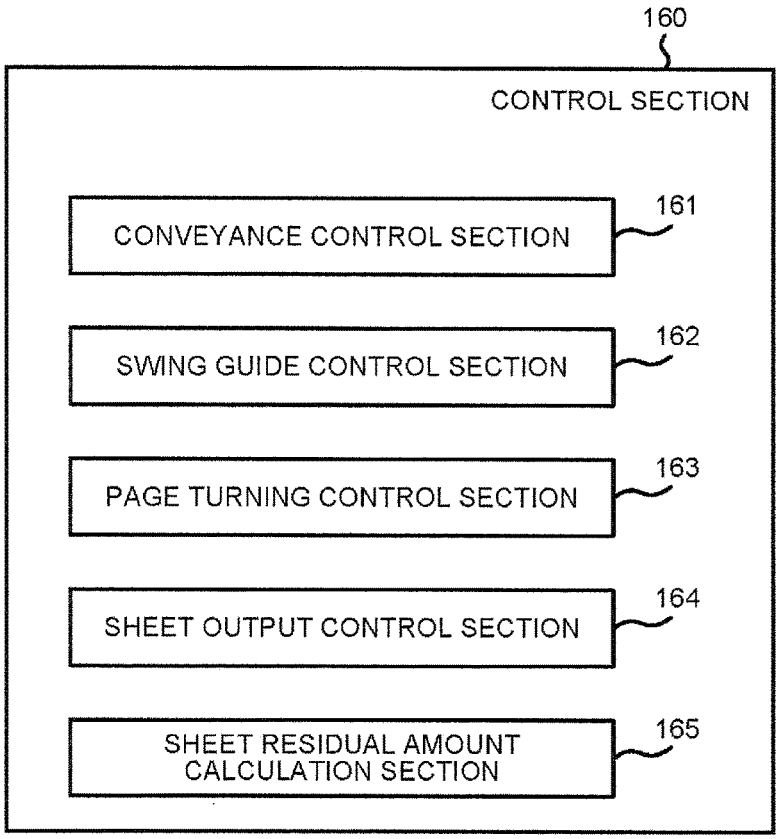
FIG. 18 is a functional block diagram illustrating the functions of the control section of the printing apparatus 2 according to the embodiment 2.

The control section 160 consists of a processing apparatus such as a processor. By carrying out a 'page turning processing' and a 'sheet output processing', the control section 160 functions as a conveyance control section 161, a swing guide control section 162, a page turning control section 163, a sheet output control section 164 and a sheet residual amount calculation section 165, as shown in FIG. 18.

Figure 19:
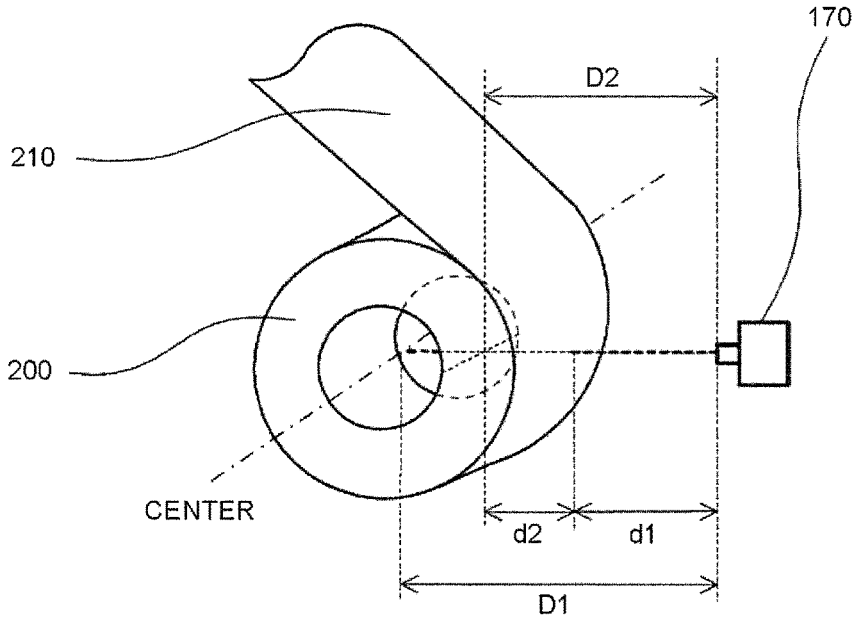
FIG. 19 is a diagram illustrating a situation in which the distance from the detection section to the outer peripheral surface of a roller is measured.

The detection section 170 which consists of, for example, a distance sensor is arranged at a position about distance D1 away from the center of the roll 200 in the radial direction, as shown in FIG. 19. Moreover, to measure the distance to the outer peripheral surface of the roll 200, the detection section 170 is arranged with the sensor thereof facing the outer peripheral surface of the roll 200. The detection section 170 measures the distance d1 to the outer peripheral surface of the roll 200 and sends the result of the measurement to the control section 160.

The storage section 180 consists of a storage apparatus such as a DRAM (Dynamic Random Access Memory), a SRAM (Static Random Access Memory), a semiconductor memory, a hard disk and the like, which are capable of reading data. Rotation control information in which the sheet residual amount of the roll 200 is in association with the information indicating the angle of the inclination of the flat section 131*a* (hereinafter referred to as 'inclination angle information') is stored in the storage section 180. The inclination angle information is, for example, information indicating the rotation amount of the swing guide 131. The less the sheet residual amount is, the greater the inclination angle stored in the inclination angle information is.

The other components of the printing apparatus 100 are the same as those of the printing apparatus 100 described in embodiment 1 and are therefore not described repeatedly.

Next, the 'sheet conveyance processing' carried out by the printing apparatus 100 is described.

When an instruction indicating the execution of a sheet output processing is given from an external apparatus, the control section 160 carries out a 'sheet output processing' which is described below with reference to the flowchart of FIG. 20.

The sheet output control section 164 controls the sheet output mechanism 140 to output the sheet 210 to the conveyance surface 112*b* (ACT S301). In this case, the sheet output control section 164 outputs the sheet 210 with the internal surface of the sheet 210 opposite to the conveyance surface.

The conveyance control section 161 conveys the sheet 210 output to the conveyance surface 112*b* to the front of the page turning mechanism 130 (ACT S302).

The sheet residual amount calculation section 165 of the control section 160 acquires a measurement result from the detection section 170. Then, the sheet residual amount calculation section 165 calculates the sheet residual amount of the roll 200 according to the acquired measurement result (ACT S303). The sheet residual amount may be thickness d2 of the roll 200 in the radial direction. As shown in FIG. 19, if the distance to the outer peripheral surface measured by the detection section 170 is d1, then the sheet residual amount calculation section 165 may calculate the thickness d2 by subtracting d1 from the distance D2 between the detection section 170 and the internal circumferential surface of the roll 200. The distance D2 may be measured and stored in the storage section 180 in advance.

Next, the swing guide control section 162 acquires, from the storage section 180, the rotation control information in which the sheet residual amount is in association with related the inclination angle information. Sequentially, the swing guide control section 162 extracts, from the rotation control information, the inclination angle information corresponding to the sheet residual amount calculated in ACT S303. Then, the swing guide control section 162 enables the swing guide 131 to rotate by changing the angle of the inclination r1 of the flat section 131*a* to the angle of inclination represented by the inclination angle information, as shown in FIG. 15 (ACT S304).

Figure 20:
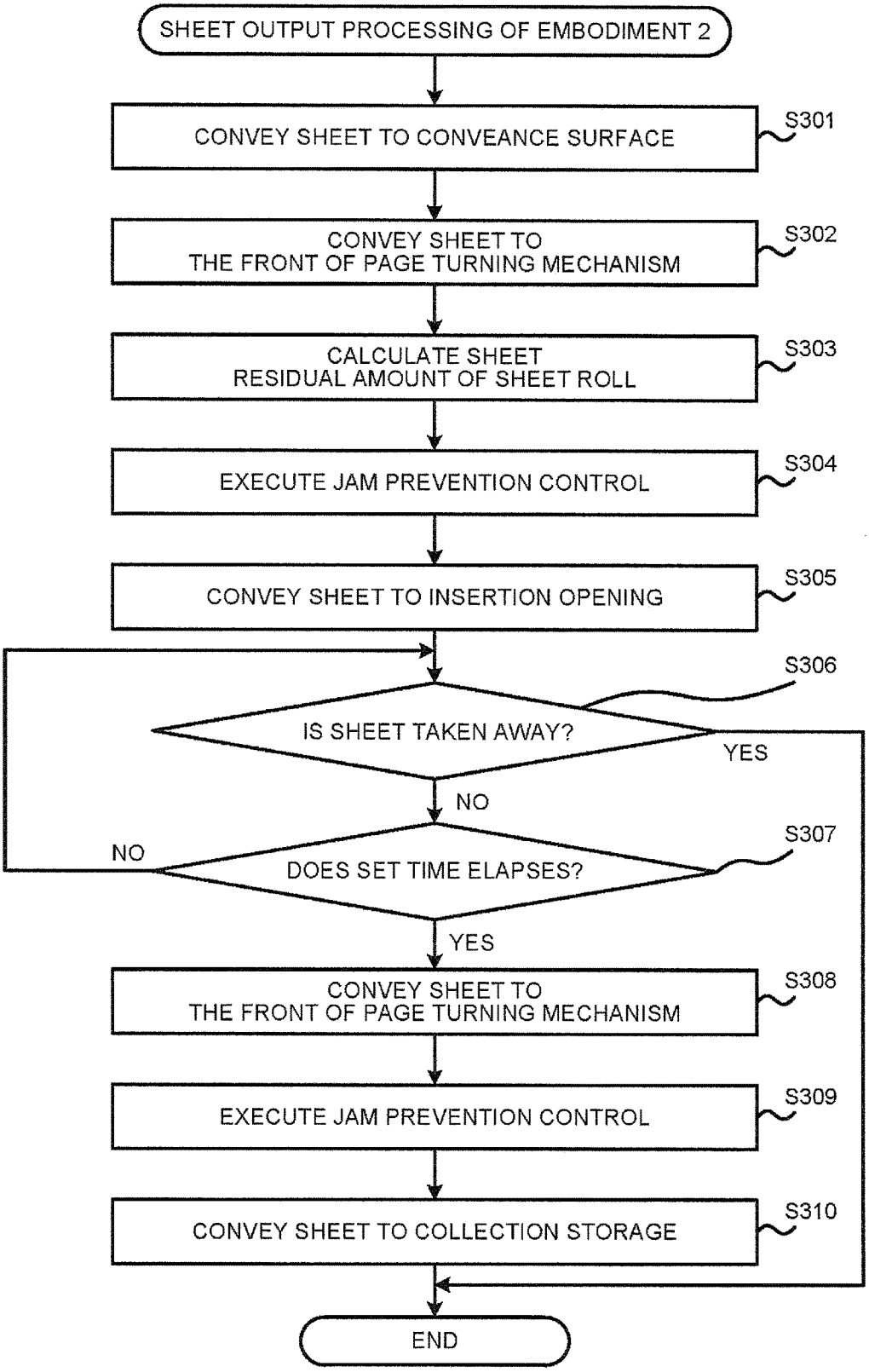
FIG. 20 is a flowchart illustrating a sheet output processing according to the embodiment 2.

Return to the flow shown in FIG. 20, the conveyance control section 161 conveys the sheet 210 to the insertion opening 111 (ACT S305).

The conveyance control section 161 determines whether or not the user takes away the sheet 210 from the insertion opening 111 according to the value of the pressure sensor (not shown) arranged on the furthest upstream conveyance roller 114 (ACT S306). If the sheet 210 is taken away (Yes in ACT S306), the control section 160 ends the sheet output processing. If the sheet 210 is not taken away (No in ACT S306), the conveyance control section 161 proceeds to ACT S307.

The conveyance control section 161 determines whether or not a set time elapses (ACT S307). If the set time is not reached (No in ACT S307), the conveyance control section 161 returns to ACT S306. If the set time elapses (Yes in ACT S307), the conveyance control section 161 proceeds to ACT S308.

If the set time elapses (Yes in ACT S307), the conveyance control section 161 considers that the user forgets to take away the sheet 210 and therefore conveys the sheet 210 to the collection storage 150. In this case, the conveyance control section 161 stops the conveyance of the sheet 210 on one end in front of the page turning mechanism 130 (ACT S308).

The swing guide control section 162 enables the swing guide 131 to rotate towards the direction reverse to the advancing direction of the sheet 210, for example, as shown in FIG. 16, to incline the flat section 131*a* with respect to the arrangement surface A (ACT S309). In this case, the swing guide control section 162 enables the swing guide 131 to rotate by changing the angle of the inclination r2 of the flat section 131*a* to the angle of inclination represented by the inclination angle information, like in ACT S304.

Return to the flow shown in FIG. 20, the conveyance control section 161 conveys the sheet 210 towards the downstream side to collect the sheet 210 into the collection storage 150 (ACT S310). After the collection is completed, the control section 160 ends the sheet output processing.

According to the embodiment, the angle of the inclination of the flat section 131*a* is changed according to the sheet residual amount, thus, the possibility that the sheet 210 enters the gap between the flat section 131*a* and the conveyance surfaces is reduced even if a curlier sheet 210 is output from the sheet output mechanism 140 as the sheet residual amount reduces.

Further, as an end of the flat section 131*a* protrudes from the arrangement surface A when the flat section 131*a* is inclined, a great pressure may be applied to the sheet 210 passing through the swing guide 131. However, in the printing apparatus 100 described herein, the angle of the inclination of the flat section 131*a* is small when the sheet residual amount is not reduced, thus, no great pressure is applied to the sheet 210 in most cases.

Further, the aforementioned embodiments are merely exemplary, and various modifications and applications are allowable.

For example, in the aforementioned embodiments, the printing medium passes a certain position of the swing guide 131 when the flat section 131*a* is inclined, however, the swing guide 131 may return to the home position H while the end of the printing medium at the side of the advancing direction passes the end of the flat section 131*a* in the advancing direction.

Figure 21A:
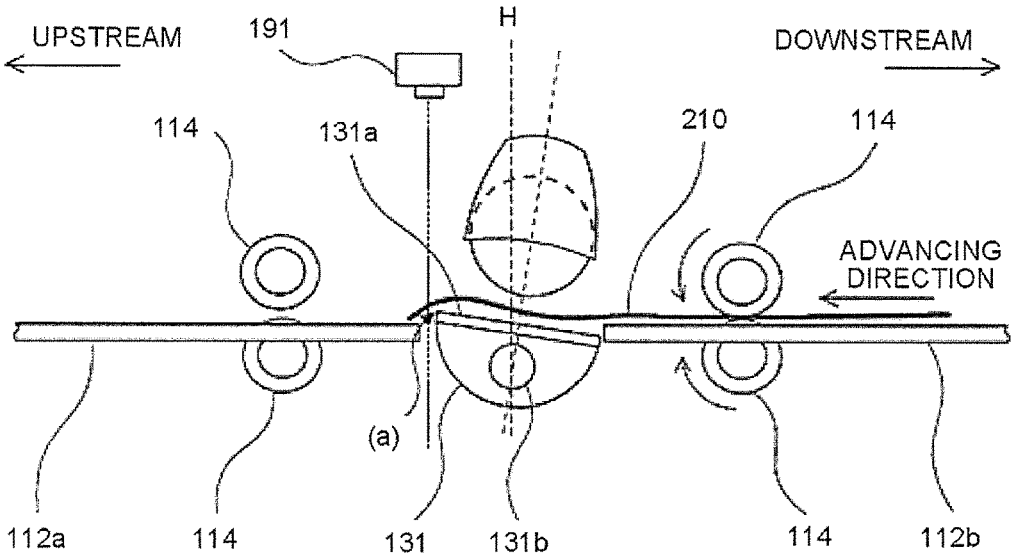
FIG. 21A is a diagram illustrating a situation in which the pass of a printing medium is detected by the detection section.
Figure 21B:
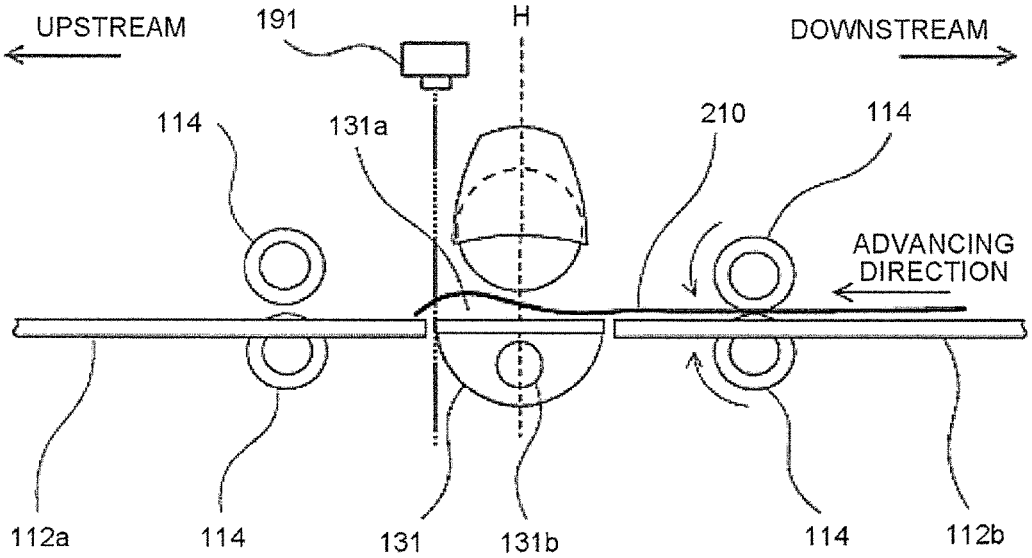
FIG. 21B is a diagram illustrating a situation in which a swing guide is returned to the home position.

For example, as shown in FIG. 21A, the printing apparatus 100 is provide with a detection section 191 for detecting the pass of the printing medium through the gap between the end of the flat section 131*a* at the side of the advancing direction ((a) shown in FIG. 21A) and the conveyance surface 112*a*. The detection section 191 may be a photoelectric sensor for detecting the printing medium or other object detection sensors. Moreover, the swing guide control section 162 returns the swing guide 131 to the home position H when the pass of the printing medium is detected by the detection section 191, as shown in FIG. 21B.

Figure 22A:
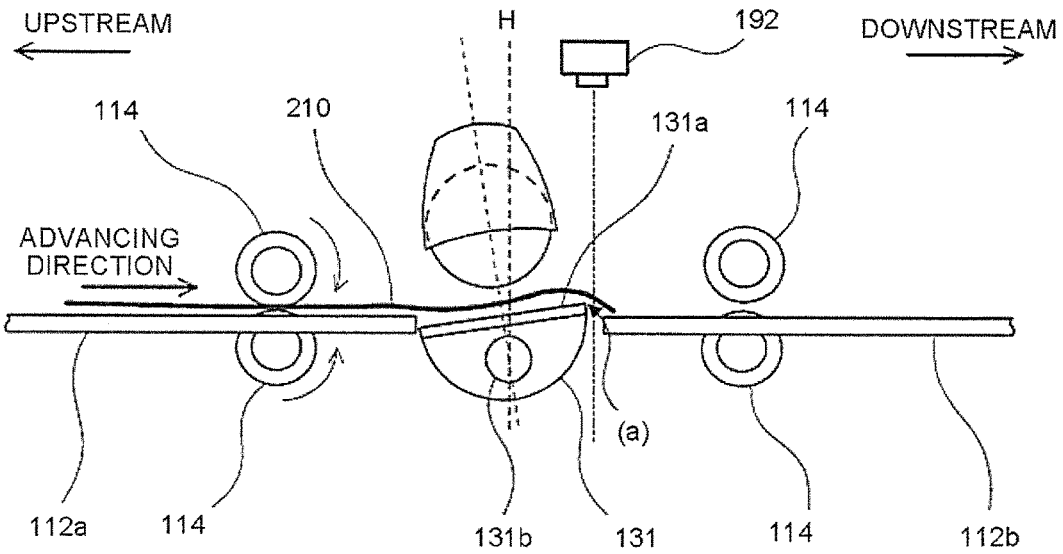
FIG. 22A is a diagram illustrating a situation in which the pass of a printing medium is detected by the detection section.
Figure 22B:
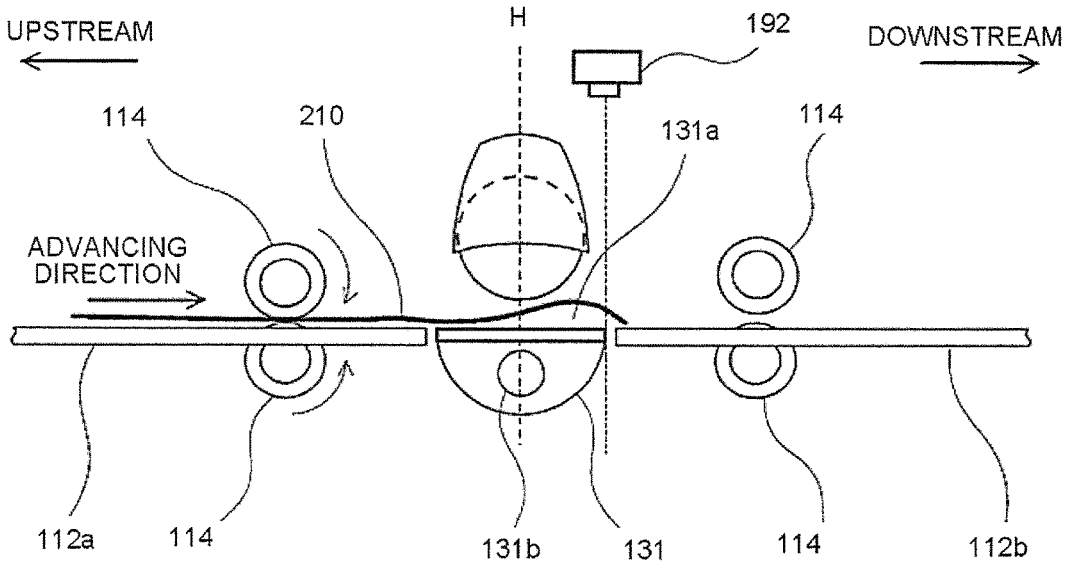
FIG. 22B is a diagram illustrating a situation in which a swing guide is returned to the home position.

Further, as shown in FIG. 22A, the printing apparatus 100 is provide with a detection section 192 for detecting the pass of the printing medium through the gap between the end of the flat section 131*a* at the side of the advancing direction ((a) shown in FIG. 22A) and the conveyance surface 112*b*. In this case, the detection section 192 may be a photoelectric sensor for detecting the printing medium or other object detection sensors. Moreover, the swing guide control section 162 returns the swing guide 131 to the home position H when the pass of the printing medium is detected by the detection section 192, as shown in FIG. 22B.

Thus, it scarcely happens that a great pressure is applied to the printing medium on an end part of the flat section 131*a* when the printing medium passes through the swing guide 131. Further, the printing apparatus 100 may comprise either or both of the detection sections 191 and 192. Further, in the examples shown in FIG. 21A-22B, the printing medium may be the sheet 210 or a booklet such as the bankbook 300.

Further, in the aforementioned embodiments, the booklet printing section 120 is a dot printer; however, the booklet printing section 120 is not limited to a dot printer. The booklet printing section 120 may be a thermal printer or an inkjet printer. The booklet printing section 120 may also be a laser printer.

Further, the Print head 141, although described as a thermal head in the aforementioned embodiments, is not limited to a thermal head. The Print head 141 may also be an inkjet printer head used in an inkjet printer or a laser printer head used in a laser printer.

Further, the sheet output mechanism 140 having a printing function is described in the aforementioned embodiments; however, the sheet output mechanism 140 may not have a printing function. In this case, information may be printed on the sheet 210 in advance.

Further, the sheet 210 is fed from the roll 200 in the aforementioned embodiments; however, the sheet 210 is not necessarily fed from the roll 200. For example, the sheet 210 may refer to a plurality of precut sheets which are stored in the printing apparatus 100. Further, the sheet 210 may be ordinary paper or thermal paper.

Further, the sheet 210, although described as statement in the aforementioned embodiments, is not limited to statement. For example, the sheet 210 may also be an advertisement advertising propaganda contents for the user or a receipt on which usage details are recorded.

Further, the printing apparatus 100, although described as a bankbook printing apparatus in the aforementioned embodiments, may be other printing apparatuses. In this case, the printing apparatus 100 may print on a booklet such as a book or memo, which is different from the bankbook 300.

Further, the control section 160 is accommodated in the printing apparatus 100 in the aforementioned embodiments; however, the sheet 160 is not necessarily accommodated in the printing apparatus 100. For example, the processor of an ATM carrying the printing apparatus 100 may function as the control section 160.

Further, the printing apparatus 100 is carried on an ATM in the aforementioned embodiments; however, the printing apparatus 100 is not necessarily carried on an ATM. The printing apparatus 100 may also be carried on other apparatuses excluding ATM. Further, the printing apparatus may have the functions of an ATM and therefore functions as an ATM. Apparently, the printing apparatus 100 may also be other printing apparatuses excluding ATM.

The printing apparatus 100 according to the aforementioned embodiments is achieved by a dedicated system or an ordinary computer system. For example, a program for executing the aforementioned operations may be stored in a computer-readable recording medium such as an optical disk, a semiconductor memory, a magnetic tape or a floppy disk, assigned to and installed in a computer and then executed to function as the printing apparatus 100. Further, the program may be stored in a disk device included in a server device on a network such as the Internet in advance and downloaded into computers. Further, the aforementioned functions may be achieved through the cooperation of an OS (Operating System) with applications software. In this case, the other elements excluding the OS may be stored in a medium and then assigned; alternatively, the other elements may be stored in a server device in advance and downloaded into computers.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A conveyance method, comprising:

a conveyance control step of conveying a printing medium at least including a booklet along a conveyance surface; and a swing guide control step of rotating a swing guide before the printing medium passes a gap between the swing guide and a page turning roller until a first end of a flat section is above an arrangement surface of a conveyance surface and a second end of the flat section is below the arrangement surface of the conveyance surface, wherein the first end of the flat section is located further along the conveyance direction than the second end of the flat section, the swing guide has the flat section substantially on the same plane with the conveyance surface at a preset rotation position and rotates around a shaft substantially orthogonal to a conveyance direction of the printing medium to incline the flat section with respect to the conveyance surface to bend the booklet on the flat section, and the page turning roller is configured at a position opposite to the flat section of the swing guide and abutted against the booklet bent by the swing guide to turn pages of the booklet.

2. The conveyance method according to claim 1, wherein in addition to the booklet, the printing medium further includes sheets.

3. The conveyance method according to claim 2, wherein the sheet is a sheet fed from a sheet roll.

4. The conveyance method according to claim 2, wherein the swing guide control step comprises rotating the swing guide until the flat section is substantially on the same plane with the conveyance surface in the case where a detection section detects the pass of the leading end of the print medium, wherein the detection section configured to detect the pass of a leading end of the printing medium over the first end of the flat surface.

5. The conveyance method according to claim 1, wherein the swing guide control step comprises rotating the swing guide until the flat section is substantially on the same plane with the conveyance surface in the case where a detection section detects the pass of a leading end of the print medium, wherein the detection section configured to detect the pass of the leading end of the printing medium over the first end of the flat surface.

6. The conveyance method according to claim 1, wherein the booklet is a bankbook.

7. The conveyance method according to claim 1, wherein the conveyance direction can switch between a downstream direction and an upstream direction.

* * * * *